United States Patent [19]

Booth et al.

[11] 4,046,307

[45] Sept. 6, 1977

[54] TWO CELL BULK CONTAINER

[75] Inventors: Vernard S. Booth; Billy W. Oswalt, both of Albany, Ga.

[73] Assignee: Olinkraft, Inc., West Monroe, La.

[21] Appl. No.: 694,756

[22] Filed: June 10, 1976

[51] Int. Cl.[2] ..... B65D 5/72; B65D 5/48

[52] U.S. Cl. ..... 229/15; 229/27; 222/88

[58] Field of Search ..... 229/15, 17 B, 17 R, 229/27, 28, 23 BT; 222/88, 541, 485; 221/302, 305

[56] References Cited

U.S. PATENT DOCUMENTS

| | | | |
|---|---|---|---|
| 3,066,842 | 12/1962 | Croley | 229/7 B |
| 3,347,446 | 10/1967 | Guyer et al. | 229/27 |
| 3,404,806 | 10/1968 | Richardson | 229/27 X |
| 3,425,615 | 2/1969 | Wood | 229/15 |
| 3,543,991 | 12/1970 | George et al. | 229/15 |
| 3,633,794 | 1/1972 | Croley | 222/88 |
| 3,701,466 | 10/1972 | Woodrow et al. | 229/17 B |
| 3,715,072 | 2/1973 | Mushopf et al. | 229/15 |
| 3,904,105 | 9/1975 | Booth | 229/15 |

*Primary Examiner*—Davis T. Moorhead
*Attorney, Agent, or Firm*—O'Brien & Marks

[57] ABSTRACT

Outside flaps, on each of two cells having adjoining wall panels secured together are secured to respective wall panels of the opposite cell to form a bridge across the respective opposite sides of the adjoining wall panels.

9 Claims, 7 Drawing Figures

TWO CELL BULK CONTAINER

BACKGROUND OF THE INVENTION

1. Field of the Invention

This invention relates to bulk material containers, and more particularly, to containers formed from corrugated paperboard for shipping and storing bulk material such as peanuts.

2. Description of the Prior Art

Paperboard containers are often used for shipping and storing bulk materials due to their light weight and low cost as well as their capability of being knocked-down or folded when empty so that they can be stored or shipped when empty in a minimum of space. For shipping and storing bulk materials, the container must be sufficiently strong to hold relatively large weights of bulk material without bulging or failure of the container walls. The prior art, as exemplified in U.S. Pat. Nos. 3,425,615, 3,543,991 and 3,904,105, contains bulk material containers having a plurality of vertical cells or rectangular tubes laminated together and of double thickness to produce containers with increased capability of withstanding stacking and bulging forces during storage or shipment. Also, the prior art, as exemplified in U.S. Pat. Nos. 3,066,842, 3,633,794, 3,701,466, and 3,715,072, contains bulk material containers having multicells formed by tubular liners enclosed in an outside box or outer jacket. Other types of containers, such as are disclosed in U.S. Pat. Nos. 3,347,446 and 3,404,806, have employed center partitions or center reinforcing panels.

SUMMARY OF THE INVENTION

The present invention is summarized in a dual cell bulk container body including a pair of sleeves each formed from four serially joined sleeve wall panels and an inside joint flap on one end panel of the sleeve panels, the one panels of the pair of sleeves being bonded together face-to-face, a pair of liners formed from three serially joined liner wall panels bonded on the inside of the other wall panels of the respective sleeves, each of the pair of sleeves including an integral outside joint flap on the other end panel of the four sleeve panels, and the exterior joint flaps being secured to the panels adjoining the one panels of the opposite sleeves.

An object of the invention is to construct a two ply multicell container having increased strength and resistance to distortion when filled and stacked.

Another object of the invention is to reinforce the junction between laminated panels of a multi-cell container to increase the resistance of the two cells from tearing apart or separating.

It is also an object of the invention to design a multicell container which can be formed easily and efficiently.

One advantage of the invention is that an extending outside tab on each cell of a two cell container provides a flat reinforcing center panel which acts as a hinge when the unit is set up prior to use.

One additional feature of the invention is that a joint tab on each cell provides a third thickness which increases stacking strength and resistance to bowing.

Another feature of the invention is that a bottom flap arrangement on the outer sleeve walls brings flaps from the outside panels across the inside liner panels to provide a sift-proof corner for retention and protection of the contents.

Other objects, advantages and features of the invention will become apparent from the following description taken in conjunction with the accompanying drawings.

DESCRIPTION OF THE PREFERRED EMBODIMENT

Figure 1:
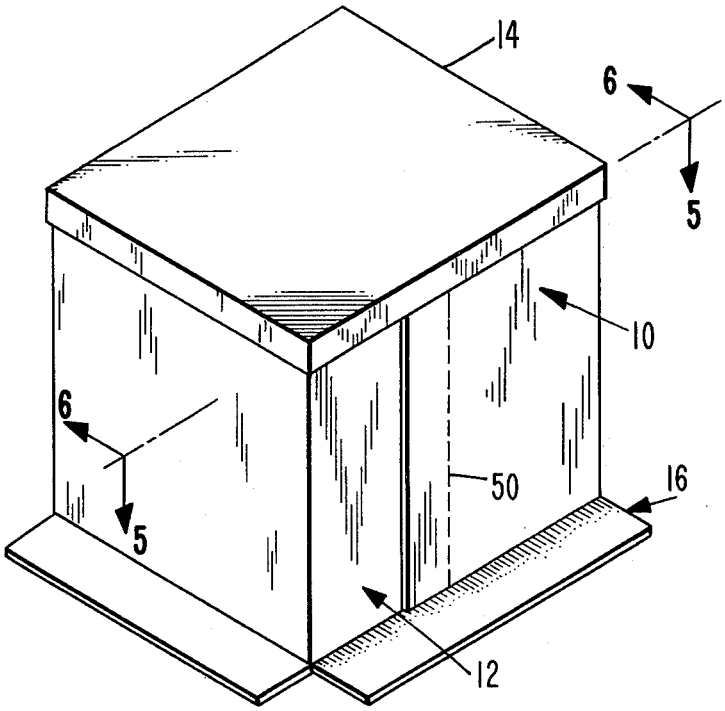
FIG. 1 is a perspective view of a two cell bulk material container in accordance with the invention.
Figure 4:
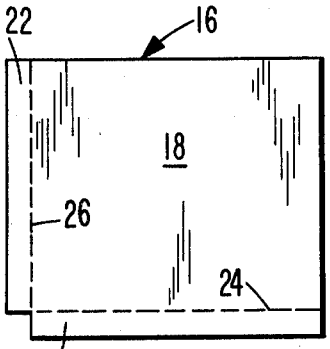
FIG. 4 is a plan view of a slip sheet for the container of FIG. 1.

As illustrated in FIG. 1, the invention is embodied in a bulk material container including a body formed by two cells indicated generally at 10 and 12, top closing means such as a top cap 14, and a bottom support means such as a slip sheet indicated generally at 16. The top cap 14 is a conventional top cap utilized in prior art bulk material containers but could be replaced by any other top closing lid or arrangement. The slip sheet 16 as shown in FIG. 4, is formed from a blank and includes a panel 18, corresponding to the bottom of the body of the container, with two flaps 20 and 22 hinged at respective score lines 24 and 26 at respective front and side edges of the panel 18; other conventional bottom supports, such as pallets, bottom caps, or the like, could be used in addition or in place of the slip sheet 16.

Figure 2:
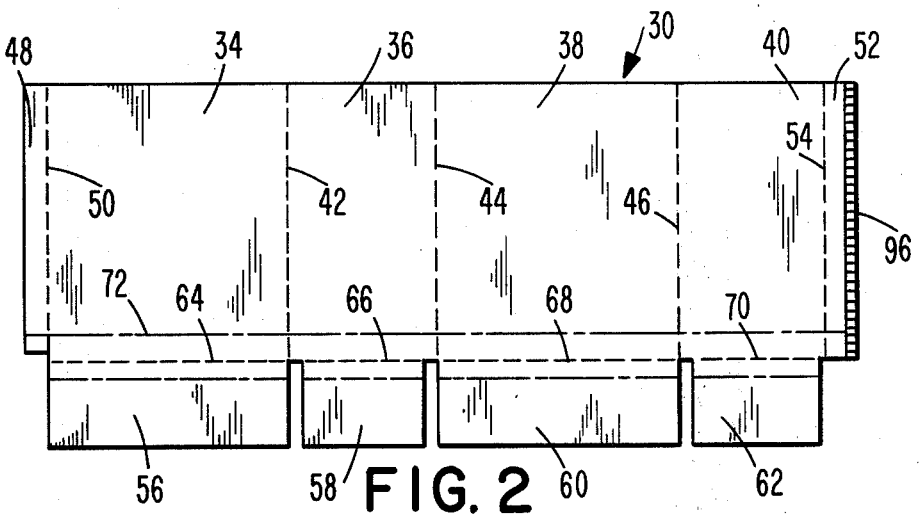
FIG. 2 is a plan view of a paperboard blank for forming a sleeve in one cell of the container of FIG. 1.
Figure 3:
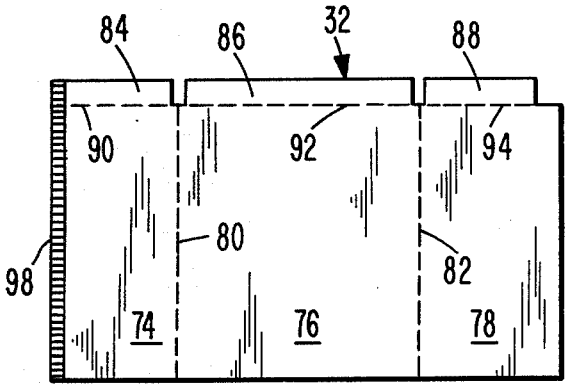
FIG. 3 is a plan view of a paperboard blank for forming a liner for one cell of the container of FIG. 1.
Figure 5:
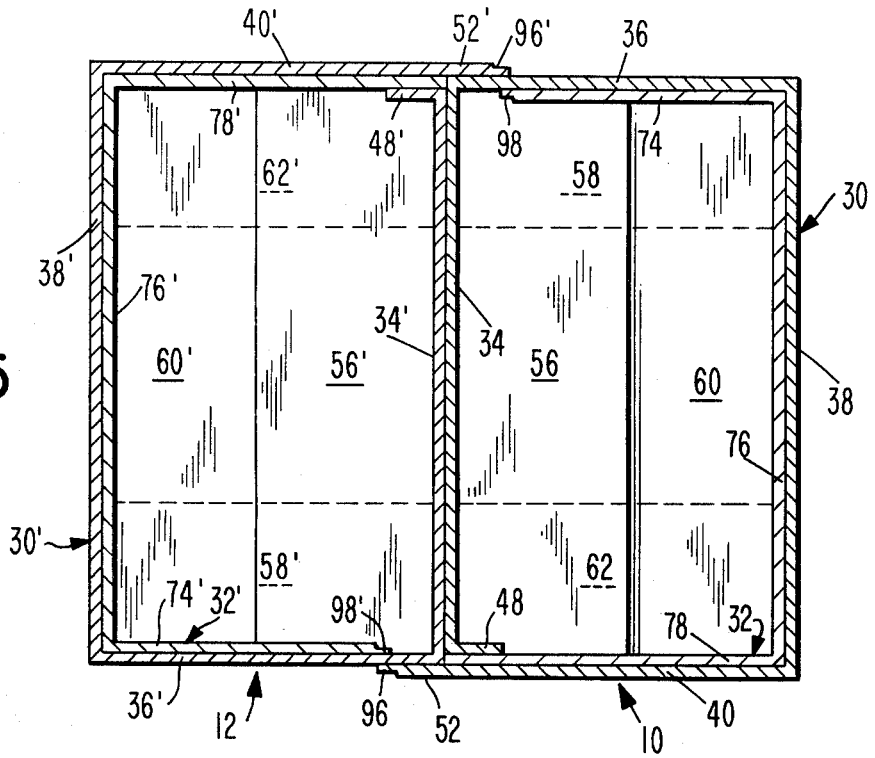
FIG. 5 is a horizontal cross-sectional view taken as indicated at 5—5 in FIG. 1.

The cell 10 of the container body, as shown in FIG. 5, is formed from a sleeve illustrated generally at 30, and a liner illustrated generally at 32, both of corrugated paperboard. The sleeve blank 30 in FIG. 2 includes four wall panels 34, 36, 38 and 40 serially hinged together by a score line 42 between the panels 34 and 36, a score line 44 between the panels 36 and 38 and a score line 46 between the panels 38 and 40. An inside joint flap 48 is integrally hinged at a score line 50 on the panel 34 at one end of the sleeve wall panels while an outside joint flap 52 is hinged at a reverse score line 54 on the panel 40 at the other end of the sleeve wall panels. Bottom flaps 56, 58, 60 and 62 are hinged at score lines 64, 66, 68 and 70 on the bottom edges of the respective panels 34, 36, 38 and 40. A reinforcing band or tape 72 extends lengthwise of the blank 30 with the width of the band 72 spanning a bottom portion of the panels 34, 36, 38 and 40, the score lines 64, 66, 68 and 70 and the outside edges of the bottom flaps 56, 58 60 and 62 adjoining the wall panels. Conveniently, the reinforcing band or tape 72 is incorporated within the corrugated paperboard during corrugation. The liner blank 32 in FIG. 3 includes a series of three wall panels 74, 76 and 78 wherein the panels 74 and 76 are hinged together at score line 80 and the panels 76 and 78 are hinged together at score line 82. Top flaps 84, 86 and 88 are hinged at score lines 90, 92 and 94 on the top edges of the respective panels 74, 76 and 78. The outer edges 96 and 98 of the outside joint flap 52 of the blank 30 and the wall panel 74 of the blank 32, respectively, are crushed as indicated at the horizontal shading lines.

Figure 6:
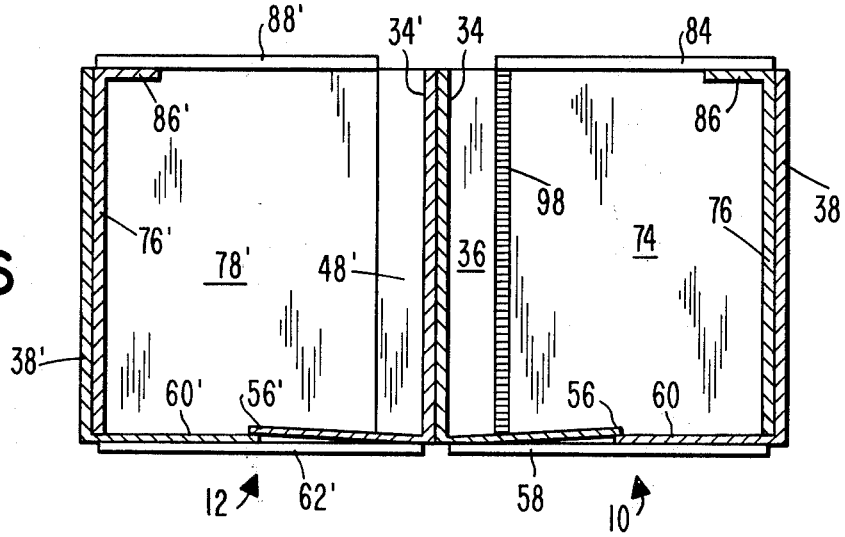
FIG. 6 is an elevation cross-sectional view taken as indicated at 6—6 in FIG. 1.

As shown in FIGS. 5 and 6, the liner wall panels 74, 76 and 78 are bonded to the inside surfaces of the respective sleeve wall panels 36, 38 and 40 by an adhesive or the like. The inside joint flap 48 is bonded to the inside surface of the liner panel 78 to form a rectangular tubular sleeve from the wall panels. The bottom flaps 56, 58, 60 and 62 are folded together horizontally to form a bottom in the container body while the top flaps 84, 86 and 88 of the liner are similarly folded inward horizontally to reinforce the walls of the cell 10 to prevent bulging of the walls outward.

The cell 12 is identical to the cell 10, except for a 180° rotation, and the corresponding parts of the cell 12 are identified by the same numerals (with the addition of a prime symbol) as used to identify the parts of the cell 10. The wall panels 34 and 34' of the cells 10 and 12 are bonded together face-to-face by an adhesive or the like such that side edge portions of the wall panels 34 and 34' adjacent to the respective wall panels 36 and 36' are offset by the thickness of the liner panels 78' and 78 to extend over the edges of the panels 78' and 78 of the respective opposite cell; the liner panels 78 and 78' have a width selected so that their edges generally abut the offset edge portions of the panels 34' and 34. The outside joint flaps 52 and 52' extend over the opposite side seams between the sleeves 30 and 30' of the respective cells 10 and 12 bridging the abutment between the panels 78 and 34' and 78' and 34, and are joined to the outside surfaces of the panels 36' and 36 of the respective opposite cells. The liner panels 74 and 74' are shorter than the corresponding panels 36 and 36' so that only extreme edge portions of the panels 74 and 74' overlap the edge portions of the respective flaps 52' and 52 on the other side of the panels 36 and 36'.

The present container body produces a substantially balanced container having improved strength to withstand forces of stacked containers. Particularly, the outside joint flaps 52 and 52' reinforce the junction between the cells 10 and 12 and the panels 34 and 34' to prevent the cells from being torn apart by the forces of the bulk material within the container together with the forces of containers stacked upon top thereof. The joint flaps 52 and 52' are bonded at the same time as the panels 34 and 34' are bonded, and thus the joint flaps 52 and 52' tend to lock the panels 34 and 34' together during the bonding to produce a better bond between the panels 34 and 34'.

Figure 7:
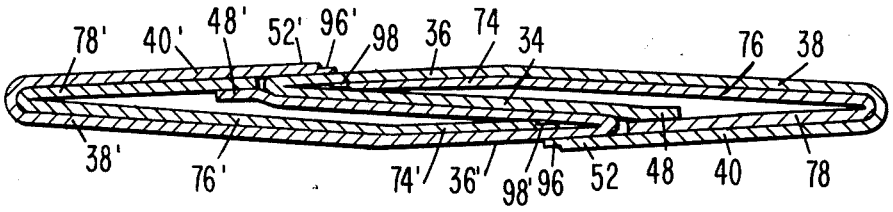
FIG. 7 is a cross-section view at the same plane as FIG. 5 but illustrating the knocked-down condition of the container of FIG. 1.

It is noted that the hinges between the inside joint flaps 48 and 48' and the panels 34 and 34' are offset with respect to the hinges between the panels 34' and 34 and 36' and 36; this offset allows the container body to be more easily folded as shown in FIG. 7.

The inside joint flaps 48 and 48' and the outside joint flaps 52 and 52' (to the extent that the flaps 52 and 52' overlap the panels 74' and 74) provide a third thickness of paperboard at the center to substantially reinforce the center and prevent bowing as well as increase the stacking strength. Also, the joint flaps 52, 52', 48 and 48' extend in a balanced arrangement to the opposite sides of the center of the container; this results in a balanced container producing even loading when stacked. When knocked-down the crushed areas 96, 96', 98 and 98' result in a lesser total thickness of the folded layers of the container body to enable a more compact folding. As the container body is bonded while flattened, the even balanced structure, particularly the outward extending flaps 48 and 48' from the double thickness center, provides a more even or lesser change in lamination thickness during bonding to more evenly distribute bonding pressures.

It is also noted that the bottom flaps 56, 58, 60 and 62 being on the outer sleeve 30 cross over the bottom edges of the liner 32 to result in substantially sift-proof corners in the cell 10 for both retention of and protection of contents in the container. The bottom flaps being on the sleeve 30 also make it easier to set-up and knock-down the container body.

Since many variations, modifications and changes in detail may be made to the described embodiment, it is intended that all matter in the foregoing description and accompanying drawings be interpreted as illustrative and not in a limiting sense.

What is claimed is:

1. A two cell bulk container body comprising a pair of sleeves each formed from four serially joined sleeve wall panels and an inside joint flap on one end panel of said series of sleeve panels, said one panels of the pair of sleeves being bonded together face to face to form opposite side seams between the sleeves, a pair of liners formed from three serially joined liner wall panels bonded on the inside of the other wall panels of the respective sleeves, each of said pair of sleeves including an integral outside joint flap on the other end panel of the series of four sleeve panels, and said outside joint flaps extending over the opposite side seams between the pair of sleeves and being secured to the wall panels adjoining the one panels of the opposite sleeves.

2. A two cell bulk container body as claimed in claim 1 including four bottom flaps hinged on the bottom edges of the respective wall panels of each of the pair of sleeves, and three top flaps hinged on the respective upper edges of the wall panels of each of the pair of liners.

3. A two cell bulk container body as claimed in claim 1 wherein the inside joint flaps of the sleeves are joined to the inside surface of one end panel of the liner to offset the hinges between the one sleeve panels and inside joint flaps relative to the hinges between the one sleeve panels and the sleeve panels adjoining the one sleeve panels.

4. A two cell bulk container body comprising a pair of sleeves each formed from four serially joined sleeve wall panels and an inside joint flap on one end panel of said sleeve panels, said one panels of the pair of sleeves being bonded together face to face, a pair of liners formed from three serially joined liner wall panels bonded on the inside of the other wall panels of the respective sleeves, each of said pair of sleeves including an integral outside joint flap on the other end panel of the four sleeve panels, each outside joint flaps being secured to the wall panel adjoining the one panel of the opposite sleeve and overlapping a portion of one end wall panel of the liner of the opposite cell, and said overlapping portions of each outside joint flap and one end liner panel being crushed.

5. A two cell bulk container body comprising a pair of sleeves each formed from four serially joined sleeve wall panels and an inside joint flap on one end panel of said sleeve panels, said one panels of the pair of sleeves being bonded together face to face, a pair of liners formed from three serially joined liner wall panels bonded on the inside of the other wall panels of the respective sleeves, each of said pair of sleeves including an integral outside joint flap on the other end panel of the four sleeve panels, said outside joint flaps being secured to the wall panels adjoining the one panels of the opposite sleeves, four bottom flaps hinged on the bottom edges of the respective wall panels of each of the pair of sleeves, three top flaps hinged on the respective upper edges of the wall panels of each of the pair of liners, and a reinforcing strip incorporated in the bottom portions of the wall panels of each sleeve and having a width extending into the bottom flaps.

6. A two cell bulk container body comprising a pair of sleeves each formed from four serially joined sleeve wall panels and an inside joint flap on one end panel of said sleeve panels, said one panels of the pair of sleeves being bonded together face to face, a pair of liners formed from three serially joined liner wall panels bonded on the inside of the other wall panels of the respective sleeves, each of said pair of sleeves including an integral outside joint flap on the other end panel of the four sleeve panels, said outside joint flaps being secured to the wall panels adjoining the one panels of the opposite sleeves, four bottom flaps hinged on the bottom edges of the respective wall panels of each of the pair of sleeves, said bottom flaps of the sleeves when folded horizontally inward engaging the bottom edges of the liner wall panels to form sift proof corners, and three top flaps hinged on the respective upper edges of the wall panels of each of the pair of liners.

7. A two cell bulk container body as claimed in claim 1 where the pair of sleeves and pair of liners are formed from corrugated paperboard.

8. A two cell bulk container including the container body as claimed in claim 1 and further including a top cap.

9. A two cell bulk container including the container body as claimed in claim 1 and further including a bottom sheet.

* * * * *